US011015493B2

(12) United States Patent
Cecur

(10) Patent No.: US 11,015,493 B2
(45) **Date of Patent: *May 25, 2021**

(54) ROCKER ARM ASSEMBLY FOR ENGINE BRAKING

(71) Applicant: Eaton Intelligent Power Limited, Dublin (IE)

(72) Inventor: Majo Cecur, Rivarolo Canavese (IT)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

This patent is subject to a terminal disclaimer.

(21) Appl. No.: 16/802,624

(22) Filed: Feb. 27, 2020

(65) Prior Publication Data

US 2020/0191026 A1 Jun. 18, 2020

Related U.S. Application Data

(63) Continuation of application No. 16/274,328, filed on Feb. 13, 2019, now Pat. No. 10,612,435, which is a (Continued)

(51) Int. Cl.
*F01L 13/06* (2006.01)
*F01L 1/16* (2006.01)

(Continued)

(52) U.S. Cl.
CPC ..... *F01L 13/06* (2013.01); *F01L 1/16* (2013.01); *F01L 1/181* (2013.01); *F01L 1/2416* (2013.01);

(Continued)

(58) Field of Classification Search
CPC ... F01L 13/06; F01L 1/16; F01L 1/181; F01L 1/2416; F01L 13/065; F01L 2001/2444
See application file for complete search history.

(56) References Cited

U.S. PATENT DOCUMENTS 4,644,914 A 2/1987 Asaoka et al.
5,193,497 A 3/1993 Hakansson (Continued)

FOREIGN PATENT DOCUMENTS

JP 63272929 A 11/1988
WO WO 9108381 A1 6/1991
WO WO 2012113126 A1 8/2012

OTHER PUBLICATIONS

U.S. Appl. No. 15/118,498, filed Aug. 12, 2016.

*Primary Examiner* — Thomas N Moulis
(74) *Attorney, Agent, or Firm* — Leydig, Voit & Mayer, Ltd.

(57) ABSTRACT

An exhaust valve rocker arm assembly operable in a combustion engine mode and an engine braking mode includes: a rocker shaft that defines a pressurized oil supply conduit; a rocker arm that receives the rocker shaft and rotates around the rocker shaft, the rocker arm including a rocker arm oil supply passage defined in the rocker arm; a valve bridge for engaging a first exhaust valve and a second exhaust valve; a hydraulic lash adjuster assembly, disposed on the rocker arm, including a first plunger body movable between a first position and a second position; and a check valve, disposed on the rocker arm, including an actuator for selectively releasing pressure in the hydraulic lash adjuster assembly. In the engine braking mode, by rotation of the rocker arm the pressurized oil supply conduit is brought into fluid communication with the rocker arm oil supply passage.

20 Claims, 11 Drawing Sheets

Related U.S. Application Data continuation of application No. 15/118,498, filed as application No. PCT/EP2014/052876 on Feb. 14, 2014, now Pat. No. 10,247,064.

(51) Int. Cl.
*F01L 1/18* (2006.01)
*F01L 1/24* (2006.01)

(52) U.S. Cl.
CPC ..... *F01L 13/065* (2013.01); *F01L 2001/2444* (2013.01)

(56) References Cited

U.S. PATENT DOCUMENTS 5,682,849 A 11/1997 Regueiro
5,806,477 A 9/1998 Regueiro
6,386,160 B1 * 5/2002 Meneely ..... F01L 1/181 123/90.16
7,905,208 B2 * 3/2011 Ruggiero ..... F02D 13/04 123/90.22
8,499,740 B2 * 8/2013 Yoon ..... F01L 13/06 123/321
8,627,791 B2 * 1/2014 Janak ..... F02M 26/01 123/90.16
8,800,531 B2 * 8/2014 Wiley ..... F01L 13/065 123/321
9,016,249 B2 * 4/2015 Roberts ..... F01L 1/18 123/90.16
2001/0003280 A1 * 6/2001 Yang ..... F02M 51/08 123/295
2005/0211206 A1 9/2005 Fuchs et al.
2008/0087239 A1 * 4/2008 Wiley ..... F01L 1/26 123/90.16
2009/0266317 A1 10/2009 Meacock
2011/0073068 A1 3/2011 Kim et al.
2011/0162620 A1 * 7/2011 Bidner ..... F02D 41/029 123/299
2012/0024260 A1 * 2/2012 Groth ..... F01L 1/26 123/321
2012/0048232 A1 3/2012 Meistrick
2012/0298057 A1 11/2012 Janak et al.
2014/0083381 A1 3/2014 Baltrucki et al.
2014/0182533 A1 7/2014 Le Forestier
2014/0182536 A1 7/2014 Yang
2014/0326212 A1 11/2014 Audibert et al.
2015/0144096 A1 5/2015 Meneely et al.
2015/0159520 A1 6/2015 Cecur
2015/0285179 A1 * 10/2015 Cohn ..... F02D 41/064 701/104
2015/0369087 A1 12/2015 Genise et al.
2016/0146074 A1 5/2016 Lynch
2016/0298508 A1 10/2016 Lahr
2016/0356187 A1 12/2016 Meneely et al.
2017/0145944 A1 * 5/2017 Felix Moreno ..... F02D 41/3094
2017/0276034 A1 * 9/2017 Cecur ..... F01L 1/2416
2018/0073401 A1 * 3/2018 Andrisani ..... F01L 1/18
2018/0087412 A1 * 3/2018 Andrisani ..... F01L 1/18
2018/0087413 A1 * 3/2018 Xi ..... F01L 13/065
2018/0298795 A1 * 10/2018 Cecur ..... F01L 13/0031
2018/0306106 A1 * 10/2018 Glugla ..... F02D 13/0203
2019/0010835 A1 * 1/2019 McCarthy, Jr. ..... F01L 13/065
2019/0145289 A1 * 5/2019 Ferreira ..... F01L 1/26 123/90.55
2019/0264584 A1 * 8/2019 Baltrucki ..... F16K 31/607
2020/0088073 A1 * 3/2020 Baltrucki ..... F01L 9/02
2020/0182108 A1 * 6/2020 VanWingerden ..... F01L 1/18
2020/0263571 A1 * 8/2020 Benn ..... F01L 1/26
2020/0325803 A1 * 10/2020 Patil ..... F01L 13/06

* cited by examiner

ROCKER ARM ASSEMBLY FOR ENGINE BRAKING

CROSS-REFERENCE TO RELATED APPLICATIONS

This application is a continuation of U.S. application Ser. No. 16/274,328, filed Feb. 13, 2019, which is a continuation of U.S. application Ser. No. 15/118,498, filed Aug. 12, 2016, which is a U.S. national stage application under 35 U.S.C. § 371 of International Application No. PCT/EP2014/052876, filed on Feb. 14, 2014, the disclosure of all such applications being hereby incorporated by reference herein. The International Application was published in English on Aug. 20, 2015, as WO 2015/120897 A1 under PCT Article 21(2).

FIELD

The present disclosure relates generally to a rocker arm assembly for use in a valve train assembly and more particularly to a rocker arm assembly that provides a compression brake function.

BACKGROUND

Compression engine brakes can be used as auxiliary brakes, in addition to wheel brakes, on relatively large vehicles, for example trucks, powered by heavy or medium duty diesel engines. A compression engine braking system is arranged, when activated, to provide an additional opening of an engine cylinder's exhaust valve when the piston in that cylinder is near a top-dead-center position of its compression stroke so that compressed air can be released through the exhaust valve. This causes the engine to function as a power consuming air compressor which slows the vehicle.

In a typical valve train assembly used with a compression engine brake, the exhaust valve is actuated by a rocker arm which engages the exhaust valve by means of a valve bridge. The rocker arm rocks in response to a cam on a rotating cam shaft and presses down on the valve bridge which itself presses down on the exhaust valve to open it. A hydraulic lash adjuster may also be provided in the valve train assembly to remove any lash or gap that develops between the components in the valve train assembly.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

An exhaust valve rocker arm assembly operable in a combustion engine mode and an engine braking mode, the exhaust valve rocker arm assembly comprising: a rocker shaft that defines a pressurized oil supply conduit; a rocker arm configured to receive the rocker shaft and configured to rotate around the rocker shaft, the rocker arm including a rocker arm oil supply passage defined in the rocker arm; a valve bridge configured to engage a first exhaust valve and a second exhaust valve; a hydraulic lash adjuster assembly, disposed on the rocker arm, including a first plunger body movable between a first position and a second position; and a check valve, disposed on the rocker arm, including an actuator configured to selectively release pressure in the hydraulic lash adjuster assembly, wherein the exhaust valve rocker arm assembly is configured such that, in the engine braking mode, by rotation of the rocker arm the pressurized oil supply conduit is brought into fluid communication with the rocker arm oil supply passage so that pressurized oil is communicated through the pressurized oil supply conduit, through the rocker arm oil supply passage and against the actuator such that the first plunger body occupies the first position and acts on the valve bridge during rotation of the rocker arm to a first angle opening the first exhaust valve a predetermined distance while the second exhaust valve remains closed.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
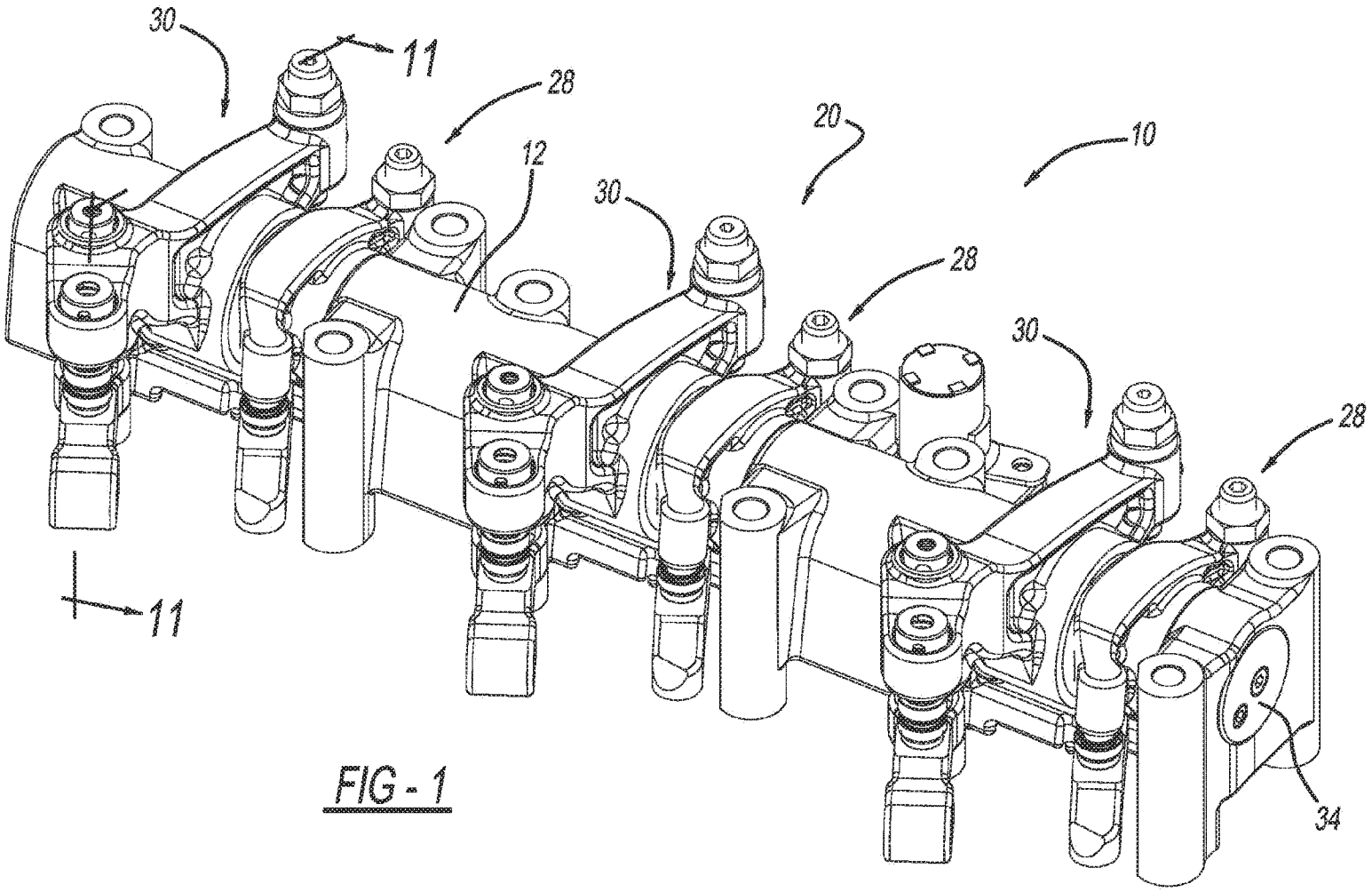
FIG. 1 is a perspective view of a partial valve train assembly incorporating a rocker arm assembly including an exhaust valve rocker arm assembly for use with compression engine braking and constructed in accordance to one example of the present disclosure.

An exhaust valve rocker arm assembly operable in a combustion engine mode and an engine braking mode can include a rocker shaft and a rocker arm. The rocker shaft can define a pressurized oil supply conduit. The rocker arm can receive the rocker shaft and is configured to rotate around the rocker shaft. The rocker arm can have an oil supply passage defined therein. A valve bridge can engage a first exhaust valve and a second exhaust valve. A hydraulic lash adjuster assembly can be disposed on the rocker arm having a first plunger body movable between a first position and a second position. In the first position, the first plunger body extends rigidly for cooperative engagement with the valve bridge. A check valve can be disposed on the rocker arm and have an actuator that selectively releases pressure in the hydraulic lash adjuster. In the engine braking mode, pressurized oil is communicated through the pressurized oil supply conduit, through the rocker arm oil supply passage and against the actuator such that the first plunger occupies the first position and acts on the valve bridge during rotation of the rocker arm to a first angle opening the first valve a predetermined distance while the second valve remains closed.

According to additional features, the hydraulic lash adjuster assembly is at least partially received by a first bore defined on the rocker arm. The hydraulic lash adjuster assembly further comprises a second plunger body that is at least partially received by the first plunger body. The second plunger body can define a valve seat. The check valve can be disposed between the first and second plunger bodies. The check valve can further comprise a check ball that selectively seats against the valve seat on the second plunger body.

According to other features, the actuator can further comprise a needle having a longitudinal pin portion and a disk portion. In the engine braking mode, pressurized oil acts against the disk portion moving the longitudinal pin portion a distance away from the check ball. The disk portion of the actuator can be received in a second bore defined in the rocker arm. The first and second bores can be collinear.

According to still other features, rotation of the rocker arm to a second predetermined angle disconnects the oil supply passage from the pressurized oil supply conduit. The rocker shaft can further define a vent channel. Rotation of the rocker arm to a third predetermined angle connects the oil supply passage to a vent channel releasing the oil pressure from the actuator. A spigot can be disposed on the rocker arm. In the engine braking mode, subsequent to the opening of the first valve the predetermined distance, further rotation of the rocker arm causes the spigot to move the valve bridge and open the second valve while further opening the first valve. The spigot can be configured to slidably translate along a passage defined in the rocker arm prior to moving the valve bridge.

An exhaust valve rocker arm assembly operable in a combustion engine mode and an engine braking mode according to additional features can include a rocker shaft that defines a pressurized oil supply conduit. A rocker arm can receive the rocker shaft and be configured to rotate around the rocker shaft. The rocker arm can have an oil supply passage defined therein. A valve bridge can engage a first exhaust valve and a second exhaust valve. A first plunger body can be movable between a first position and a second position. In the first position, the first plunger body extends rigidly for cooperative engagement with the valve bridge. An actuator can selectively release pressure acting against the first plunger body. In the engine braking mode, pressurized oil can be communicated through the pressurized oil supply conduit, through the rocker arm oil supply passage and against the actuator such that the first plunger occupies the first position and acts on the valve bridge during rotation of the rocker arm to a first angle opening the first valve a predetermined distance while the second valve remains closed.

According to other features, rotation of the rocker arm to a second predetermined angle disconnects the oil supply passage from the pressurized oil supply circuit. The rocker shaft can further define a vent channel. Rotation of the rocker arm to a third predetermined angle connects the oil supply passage to a vent channel releasing the oil pressure from the actuator. A spigot can be disposed on the rocker arm. In the engine braking mode, subsequent to the opening of the first valve the predetermined distance, further rotation of the rocker arm causes the spigot to move the valve bridge and open the second valve while further opening the first valve. A second plunger body can be at least partially received by the first plunger body. The second plunger body can define a valve seat. A check valve can be disposed between the first and second plunger bodies. The check valve can further include a check ball that selectively seats against the valve seat on the second plunger body.

According to additional features, the actuator can further comprise a needle having a longitudinal pin portion and a disk portion. In the engine braking mode, pressurized oil acts against the disk portion moving the longitudinal pin portion a distance away from the check ball. The disk portion of the actuator can be received in a second bore defined in the rocker arm. The first and second bores can be collinear.

An exhaust valve rocker arm assembly operable in a combustion engine mode and an engine braking mode according to another example of the present disclosure includes a rocker shaft that defines a pressurized oil supply conduit and a vent channel. A rocker arm can receive the rocker shaft and be configured to rotate around the rocker shaft. The rocker arm can have an oil supply passage defined therein. A valve bridge can engage a first exhaust valve and a second exhaust valve. A first plunger body can be movable between a first position and a second position. In the first position the first plunger body extends rigidly for cooperative engagement with the valve bridge. A check valve can be disposed on the rocker arm and have an actuator that selectively releases pressure acting on the first plunger body. In the engine braking mode the rocker arm is configured to rotate (i) a first predetermined angle wherein pressurized oil is communicated through the pressurized oil supply conduit, through the rocker arm oil supply passage and against the actuator. The first plunger occupies the first position and acts on the valve bridge opening the first valve a predetermined distance while the second valve remains closed. The rocker arm continues to rotate (ii) a second predetermined angle wherein the rocker arm oil supply passage disconnects from the pressurized oil conduit and (iii) a third predetermined angle wherein the rocker arm oil supply passage connects with the vent channel releasing oil pressure from the actuator.

In other features, the exhaust valve rocker assembly further comprises a spigot disposed on the rocker arm. In the engine braking mode, subsequent to the opening of the first valve the predetermined distance, further rotation of the rocker arm causes the spigot to move the valve bridge and open the second valve while further opening the first valve.

With initial reference to FIG. 1, a partial valve train assembly constructed in accordance to one example of the present disclosure is shown and generally identified at reference 10. The partial valve train assembly 10 utilizes engine braking and is shown configured for use in a three-cylinder bank portion of a six-cylinder engine. It will be appreciated however that the present teachings are not so limited. In this regard, the present disclosure may be used in any valve train assembly that utilizes engine braking.

The partial valve train assembly 10 can include a rocker assembly housing 12 that supports a rocker arm assembly 20 having a series of intake valve rocker arm assemblies 28 and a series of exhaust valve rocker arm assemblies 30. A rocker shaft 34 is received by the rocker housing 30. As will be described in detail herein, the rocker shaft 34 cooperates with the rocker arm assembly 20 and more specifically to the exhaust valve rocker arm assemblies 30 to communicate oil to the exhaust valve rocker arm assemblies 30 during engine braking.

Figure 2:
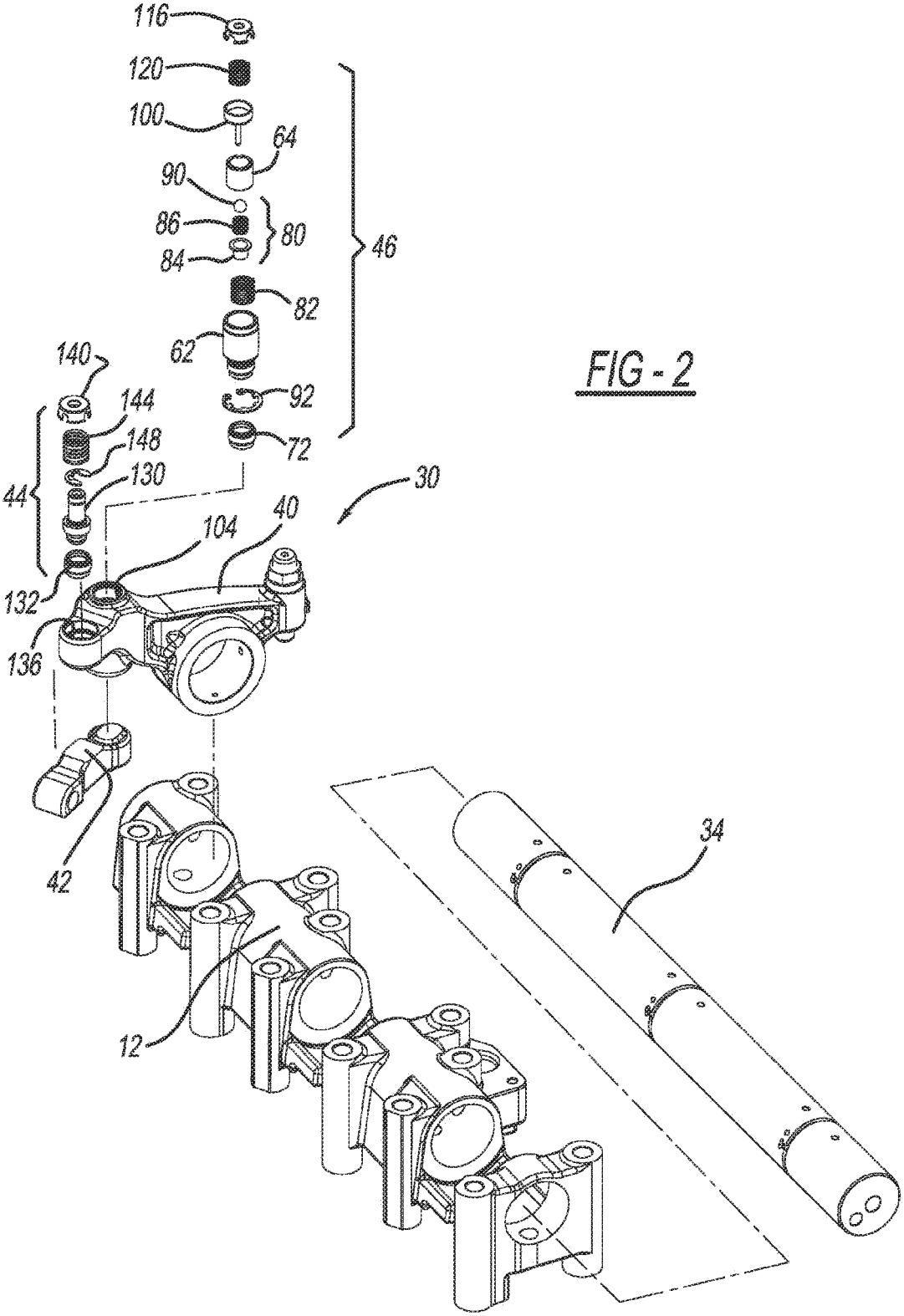
FIG. 2 is an exploded view of an exhaust valve rocker arm assembly of the valve train assembly of FIG. 1.
Figure 3:
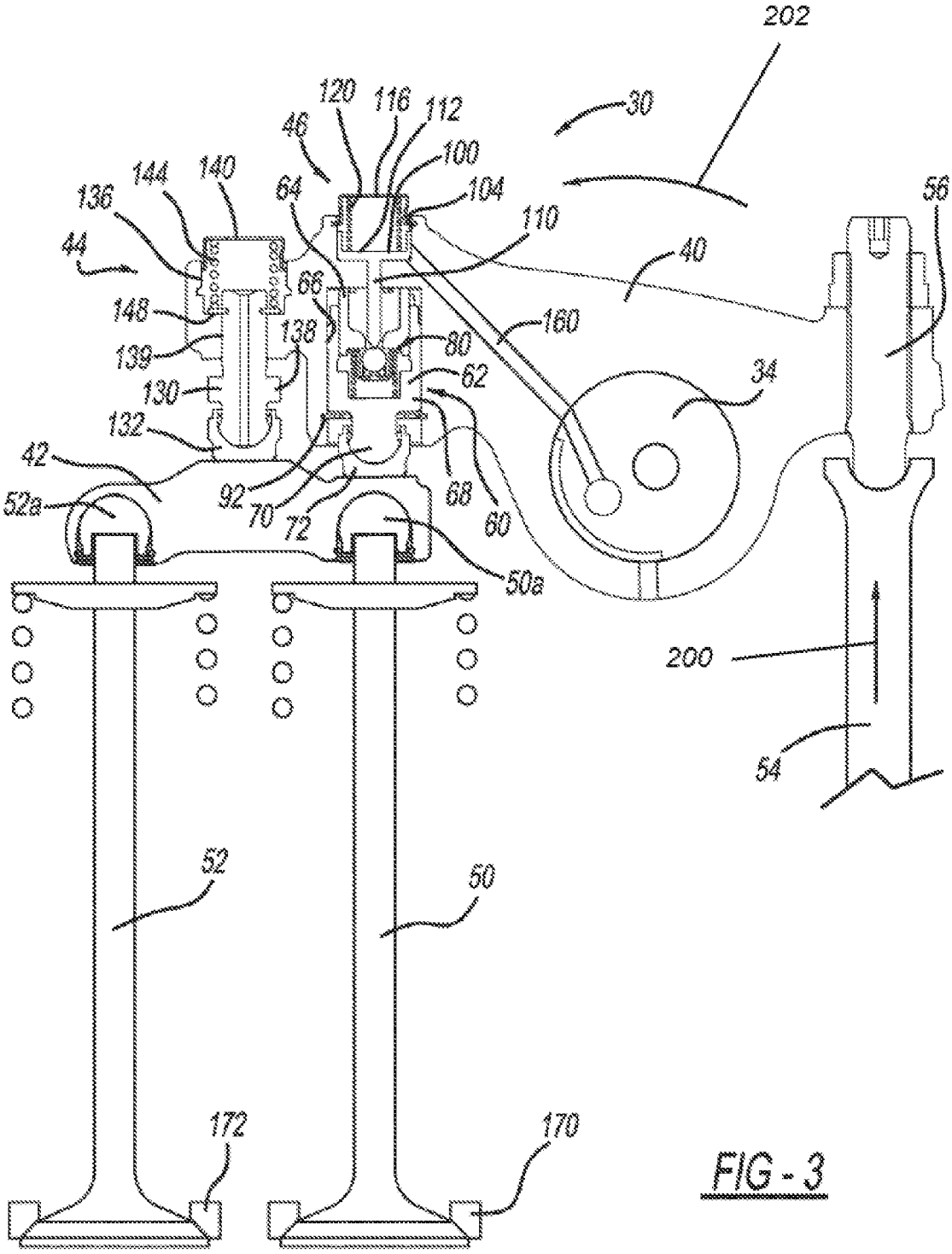
FIG. 3 is a schematic illustration of an exhaust valve rocker arm assembly of the valve train assembly of FIG. 1 and shown in a default combustion mode.

With further reference now to FIGS. 2 and 3, an exhaust valve rocker arm assembly 30 will be further described. The exhaust valve rocker arm assembly 30 can generally include a rocker arm 40, a valve bridge 42, a spigot assembly 44 and a hydraulic lash adjuster (HLA) assembly 46. The valve bridge 42 engages a first and second exhaust valve 50 and 52 (FIG. 3) associated with a cylinder of an engine. The first and second exhaust valves 50 and 52 have a corresponding elephant foot or E-foot 50*a* and 52*a*. The E-feet 50*a* and 52*a* allow the valve bridge 42 to move without creating any side load on the corresponding valve stem 50 and 52. The E-foot 50*a* is spherical. The E-foot 52*a* is cylindrical. A pushrod 54 (FIG. 3) moves upward and downward based on a lift profile of a cam shaft. Upward movement of the pushrod 54 pushes an arm 56 fixed to the rocker arm 40 and in turn causes the rocker arm 40 to rotate counter-clockwise around the rocker shaft 34.

Figure 4:
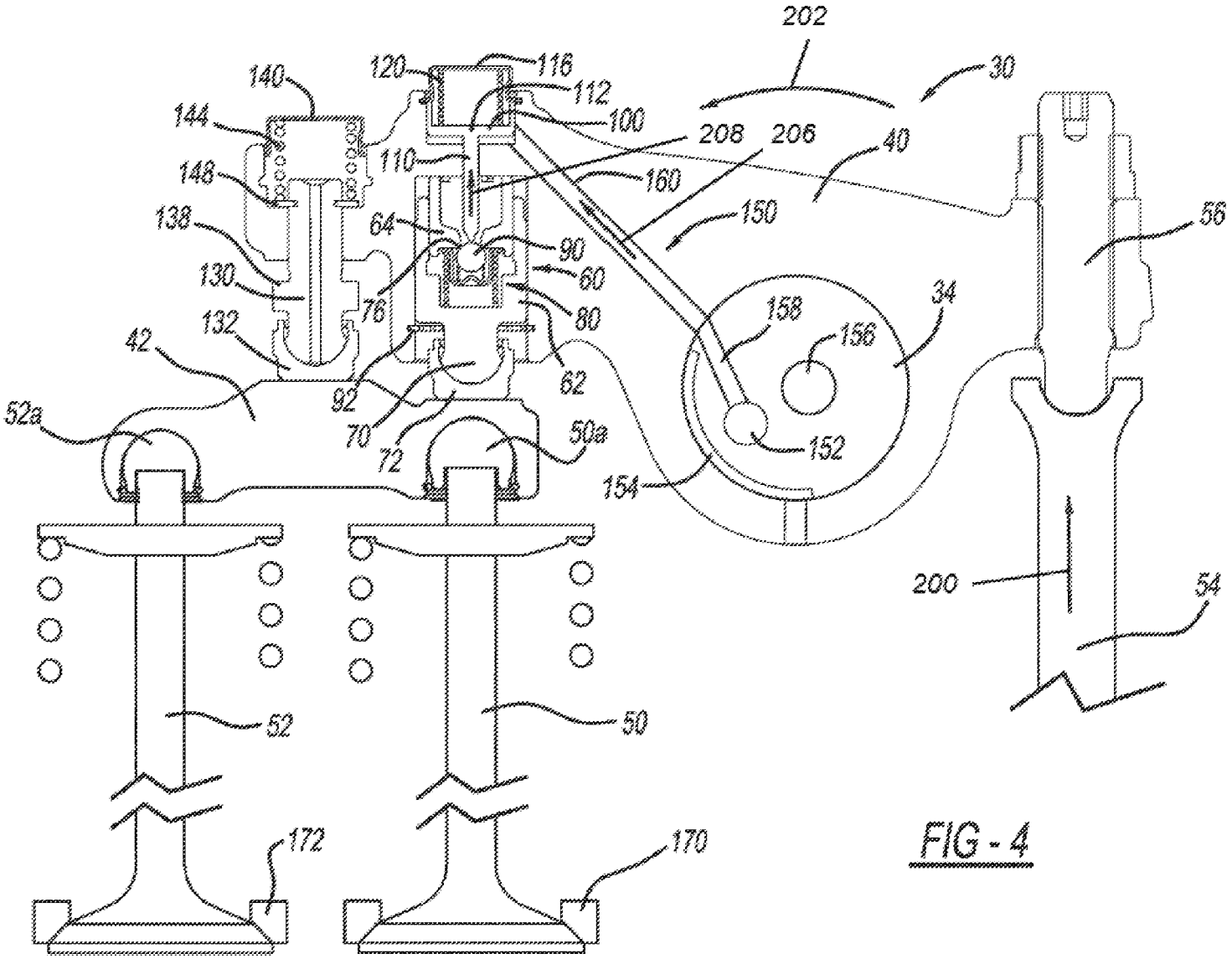
FIG. 4 is a schematic illustration of the exhaust valve rocker arm assembly of FIG. 3 and shown in an engine brake mode.

The HLA assembly 46 can comprise a plunger assembly 60 including a first plunger body 62 and a second plunger body 64. The second plunger body 64 can be partially received by the first plunger body 62. The plunger assembly 60 is received by a first bore 66 defined in the rocker arm 40. The first plunger body 64 can have a first closed end 68 that defines a first spigot 70 which is received in a first socket 72 that acts against the valve bridge 42. The second plunger body 64 has an opening that defines a valve seat 76 (FIG. 4). A check ball assembly 80 can be positioned between the first and second plunger bodies 62 and 64. The check ball assembly 80 can include a first biasing member 82, a cage 84, a second biasing member 86 and a check ball 90. A snap ring 92 nests in a radial groove provided in the first bore 66 of the rocker arm 40. The snap ring 92 retains the first plunger body 62 in the first bore 66.

An actuator or needle 100 is received in a second bore 104 of the rocker arm 40. The needle 100 acts as an actuator that selectively releases pressure in the HLA assembly 46. The needle 100 includes a longitudinal pin portion 110 and an upper disk portion 112. A first cap 116 is fixed to the rocker arm 40 at the second bore 104 and captures a biasing member 120 therein. The biasing member 120 acts between the first cap 116 and the upper disk portion 112 of the needle 100. In the example shown, the biasing member 120 biases the needle 100 downwardly as viewed in FIG. 3.

The spigot assembly 44 will be described in greater detail. The spigot assembly 44 can generally include a second spigot 130 having a distal end that is received by a second socket 132 and a proximal end that extends into a third bore 136 defined in the rocker arm 40. A collar 138 can extend from an intermediate portion of the second spigot 130. The second spigot 130 can extend through a passage 139 formed through the rocker arm 40. A second cap 140 is fixed to the rocker arm 40 at the third bore 136 and captures a biasing member 144 therein. The biasing member 144 acts between the second cap 140 and a snap ring 148 fixed to the proximal end of the second spigot 130. As will be described, the second spigot 130 remains in contact with the rocker arm 40 and is permitted to translate along its axis within the passage 139.

Figure 10:
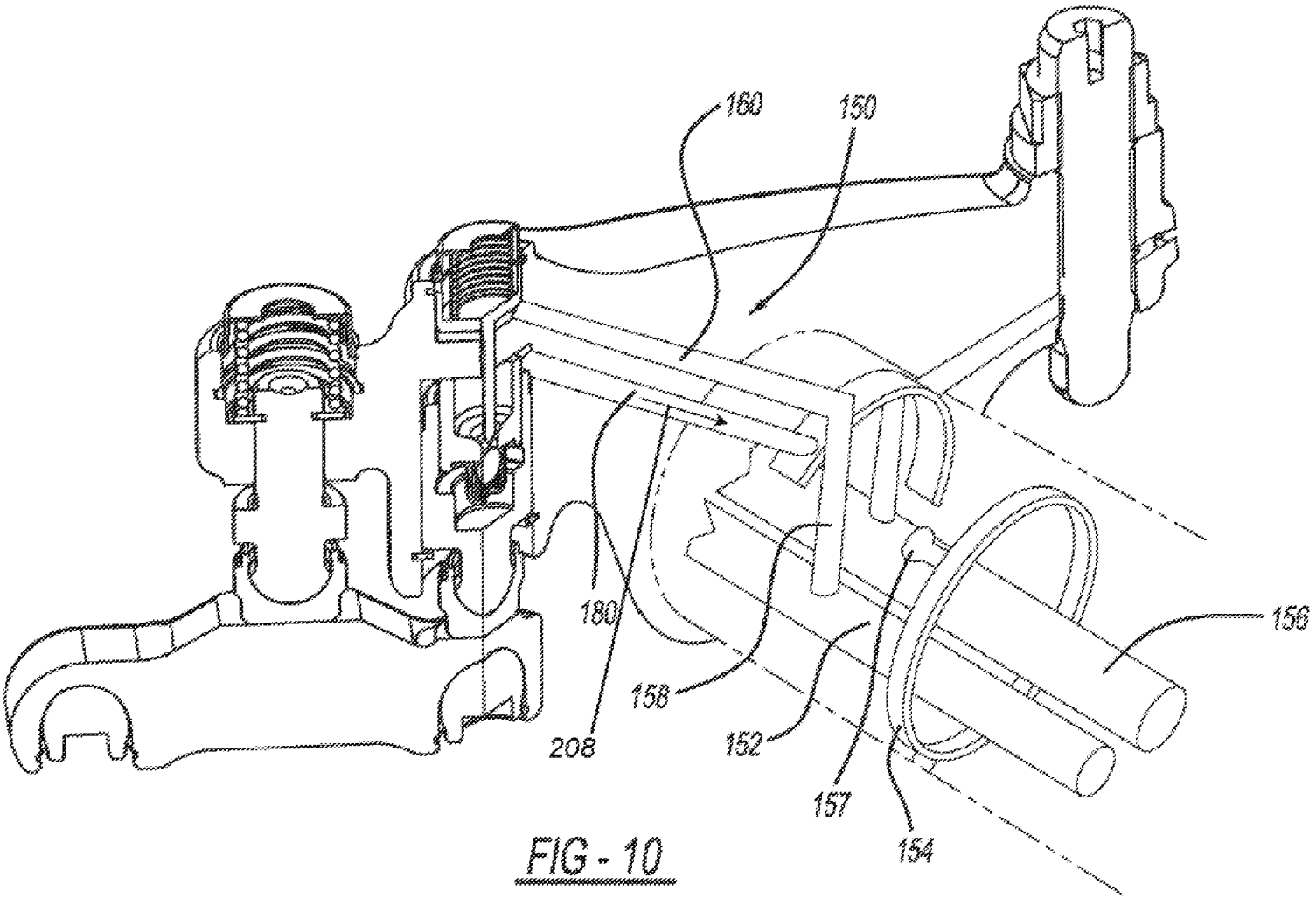
FIG. 10 is a phantom perspective view of an oil circuit of the exhaust rocker arm assembly.
Figure 11:
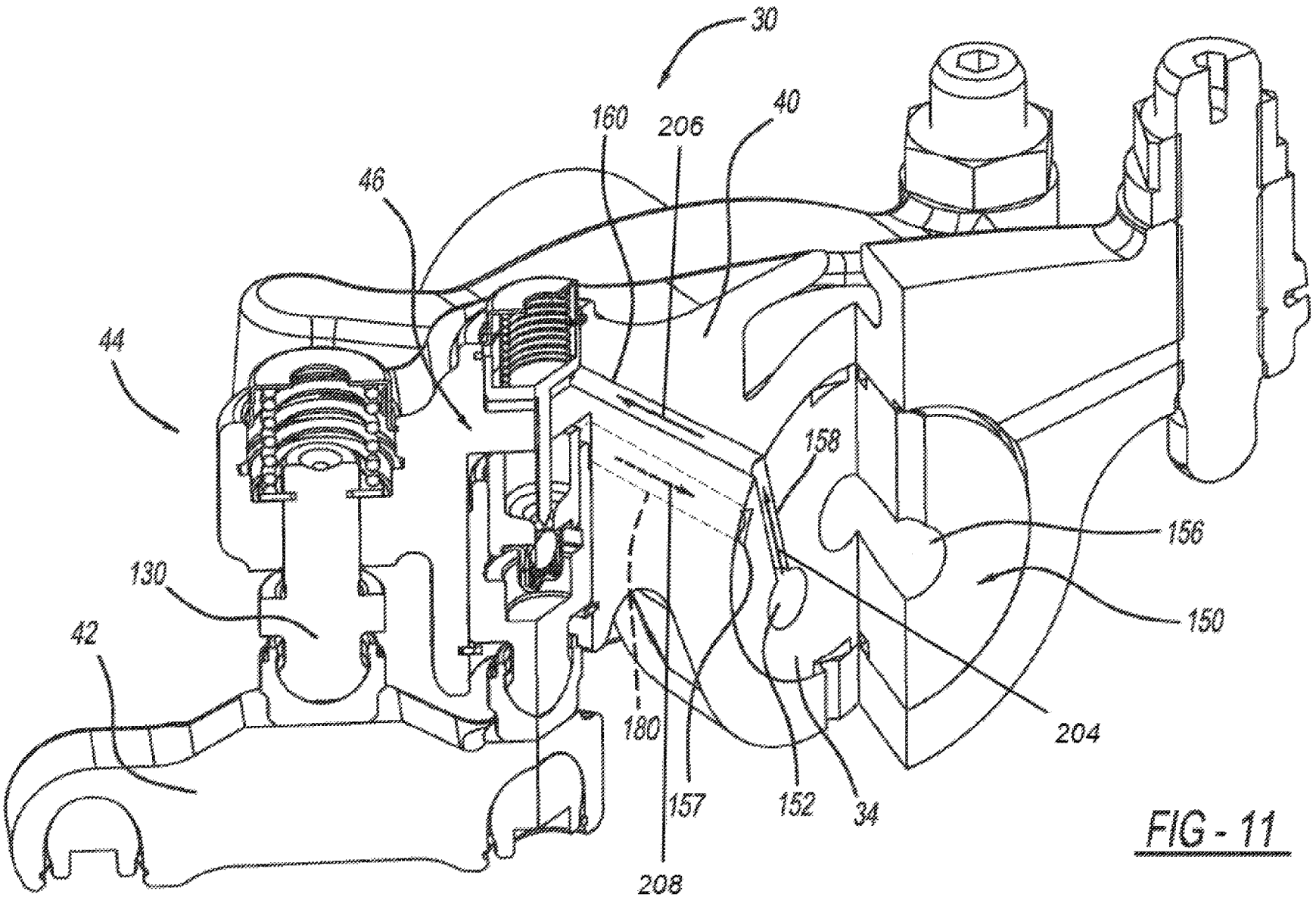
FIG. 11 is a sectional view of the exhaust rocker arm assembly taken along lines 11-11 of FIG. 1.

With reference now to FIGS. 4 and 9-11, an oil circuit 150 of the rocker arm assembly 20 will now be described. The rocker shaft 34 can define a central pressurized oil supply conduit 152, a vent oil passage or conduit 154, a lubrication conduit 156 and a lash adjuster oil conduit 180. The vent oil conduit 154 can have a vent lobe 157 extending generally parallel to an axis of the rocker shaft 34 and transverse to the vent oil conduit 154. A connecting passage 158 (FIG. 11) can connect the central pressurized oil supply conduit 152 with an oil supply passage 160 defined in the rocker arm 40. As discussed herein, the pressurized oil supply conduit 152, the connecting passage 158 and the oil supply passage 160 cooperate to supply pressurized oil to the second bore 104 to urge the upper disk portion 112 of the needle 100 upward. As the rocker arm 40 rotates around the rocker shaft 34, the vent lobe 157 will align with the oil supply conduit causing oil to be vented away from the second bore 104 through the vent oil conduit. When the pressure drops in the second bore 104, the second spring 120 will urge the needle 100 downward such that the longitudinal pin 110 will act against the ball 90 and move the ball away from the valve seat 76. Oil is then permitted to flow through the valve seat 76 and out of the HLA assembly 46 through the lash adjuster oil conduit 180 (FIG. 10).

Figure 5:
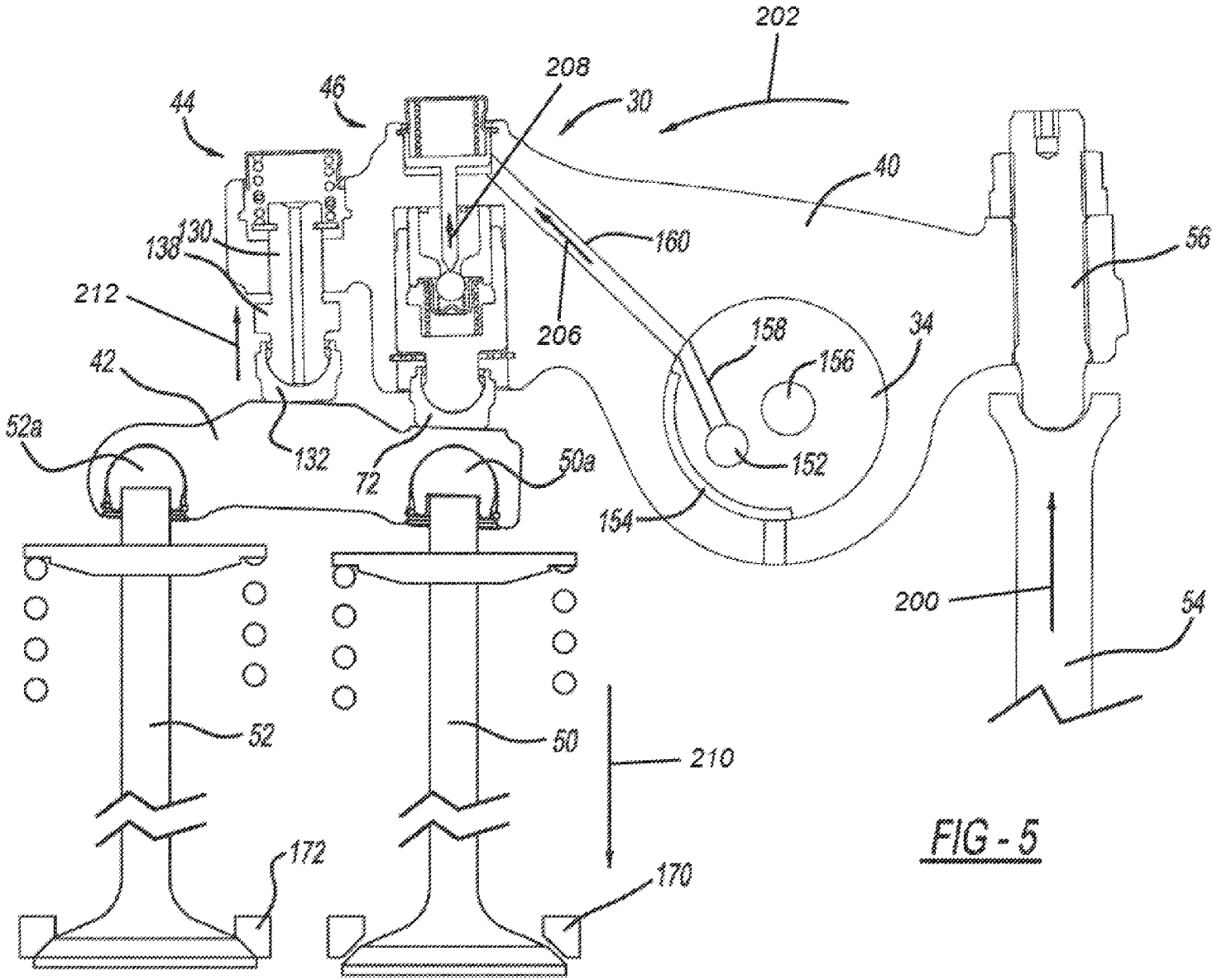
FIG. 5 is a schematic illustration of the exhaust valve rocker arm assembly of FIG. 4 and shown in engine brake mode with initial rotation of the rocker arm in the counter-clockwise direction and a first exhaust valve beginning to open.
Figure 6:
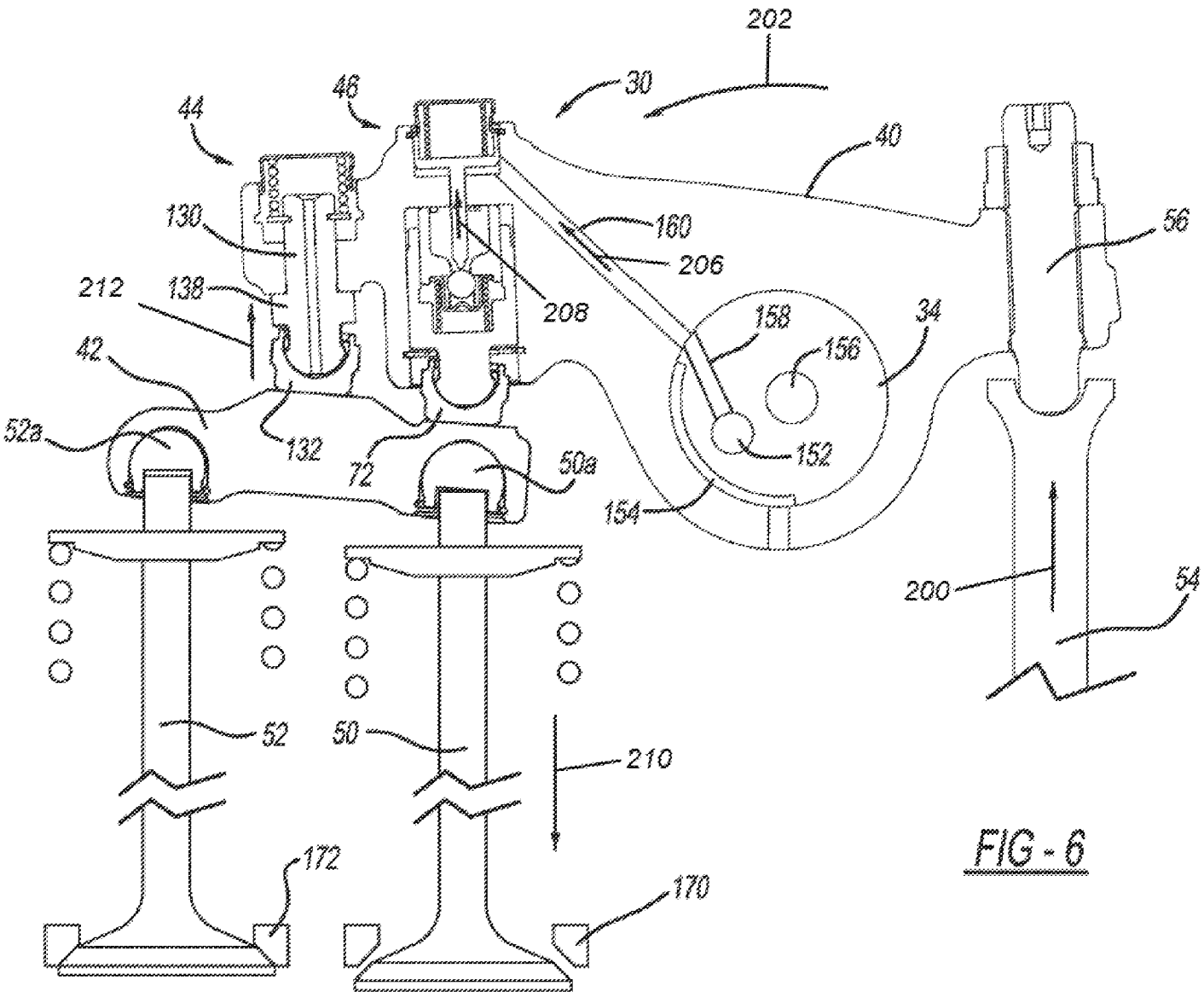
FIG. 6 is a schematic illustration of the exhaust valve rocker arm assembly of FIG. 5 and shown in engine brake mode with further rotation of the rocker arm in the counter-clockwise direction and with the first exhaust valve further opening.

As will become appreciated herein, the exhaust rocker arm assembly 30 can operate in a default combustion engine mode with engine braking off (FIG. 3) and an engine braking mode (FIGS. 4-6). When the exhaust rocker arm assembly 30 is operating in the default combustion engine mode (FIG. 3), an oil control valve 152 is closed (not energized). As a result, the oil supply passage 160 defined in the rocker arm 40 has low pressure such as around 0.3 bar. Other pressures may be used. With low pressure, the biasing member 120 will force the needle 100 in a downward direction causing the longitudinal pin portion 110 to urge the ball 90 away from the valve seat 76. The check ball assembly 80 is therefore open causing the HLA assembly 46 to become "soft" and not influencing a downward force upon the valve bridge 42. In the default combustion engine mode (FIG. 3), rotation of the rocker arm 40 in the counter-clockwise direction will continue causing the collar 138 on the second spigot 130 to engage the rocker arm 40. Continued rotation of the rocker arm 40 will cause both the first and the second valves 50 and 52 to open together.

With specific reference now to FIG. 4, operation of the exhaust valve rocker arm assembly 30 in the engine braking mode will be described. In braking mode, oil pressure is increased in oil supply passage 160 causing the needle 100 to move upward against the bias of the biasing member 120. As a result, the longitudinal pin portion 110 is moved away from the check ball 90. The HLA assembly 46 acts as a no-return valve with the first plunger body 62 rigidly extending toward the valve bridge 42.

Turning now to FIG. 5, the rocker arm 40 has rotated further counter-clockwise around the rocker shaft 34. In the example shown, the rocker arm 40 has rotated 2.72 degrees. Because the HLA assembly 46 is rigid, the first spigot 70 will force the first socket 72 against the valve bridge 42 causing the first valve 50 to move off a first valve seat 170. In this example, the first valve 50 moves off the first valve seat 170 a distance of 2.85 mm. It will be appreciated that other distances (and degrees of rotation of the rocker arm 40) are contemplated. Notably, the second valve 52 remains closed against a second valve seat 172. The collar 138 on the second spigot 130, while traveling toward the rocker arm 40, has not yet reached the rocker arm 40. The second spigot 130 remains in contact (through the second socket 132) with the rocker arm 40.

With reference now to FIG. 6, the rocker arm 40 has rotated further counter-clockwise around the rocker shaft 34. In the example shown, the rocker arm 40 has rotated 4.41 degrees. Again, the HLA assembly 46 remains rigid and the first spigot 70 continues to force the first socket 72 against the valve bridge 42 causing the first valve 50 to move further off the first valve seat 170. In this example, the first valve 50 moves off the first valve seat 170 a distance of 4.09 mm. It will be appreciated that other distances (and degrees of rotation of the rocker arm 40) are contemplated. At this point the collar 138 has made contact with the rocker arm 40 and both the first and second valves 50 and 52 will be opened concurrently.

Figure 7:
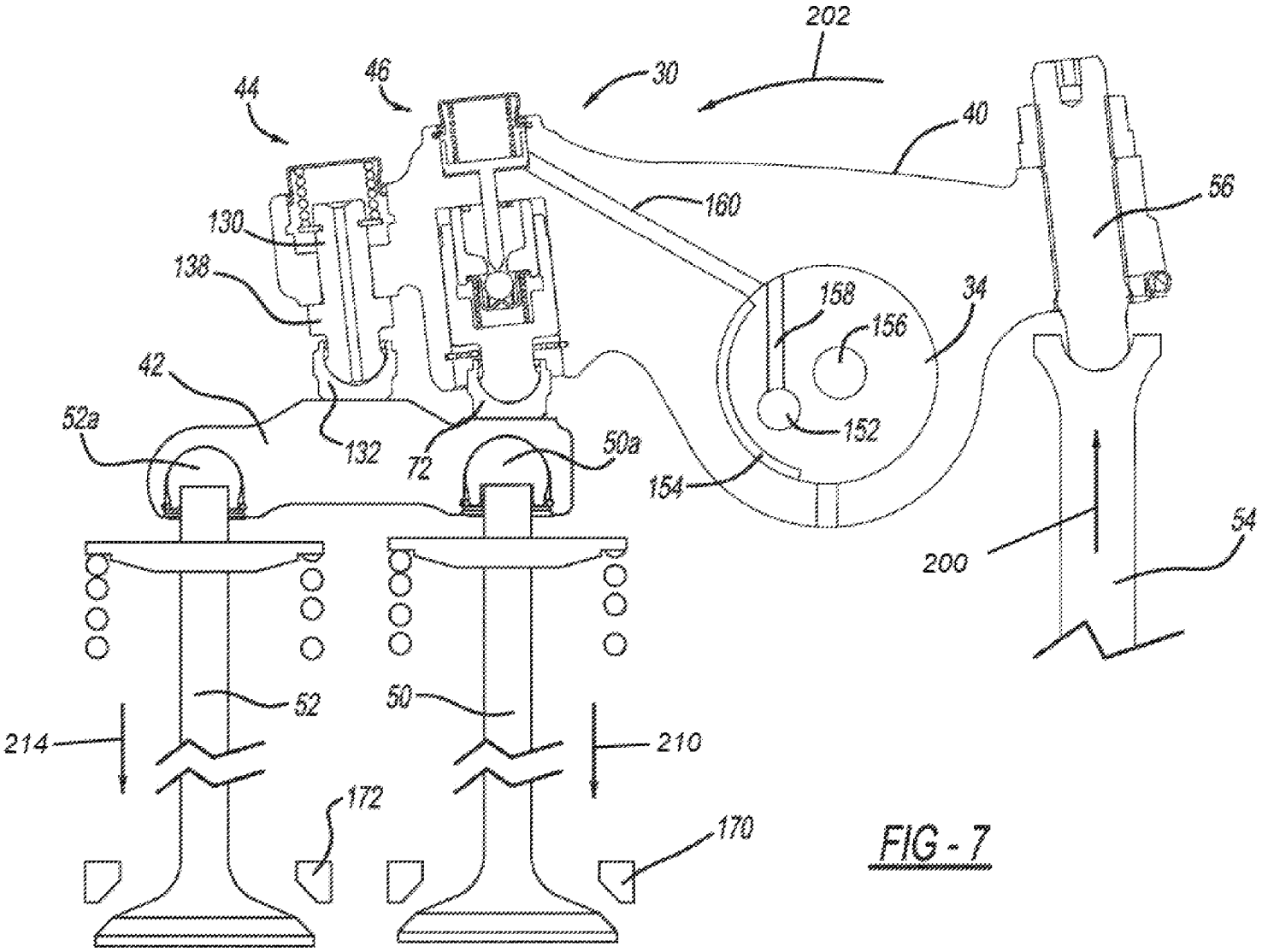
FIG. 7 is a schematic illustration of the exhaust valve rocker arm assembly of FIG. 6 and shown in engine brake mode with further rotation of the rocker arm in the counter-clockwise direction and shown with the first and a second exhaust valves both opened.

Turning now to FIG. 7, the rocker arm 40 has rotated further counter-clockwise around the rocker shaft 34. In the example shown, the rocker arm 40 has rotated 8.82 degrees. Again, the HLA assembly 46 remains rigid. Regardless, the second spigot 130 urges the bridge 42 downward to open the first and second valves 50 and 52 off their respective valve seats 170 and 172. In this example, the first and second valves 50 and 52 are moved off their valve seats 170 and 172 a distance of 9.1 mm. It will be appreciated that other distances (and degrees of rotation of the rocker arm 40) are contemplated.

Figure 8:
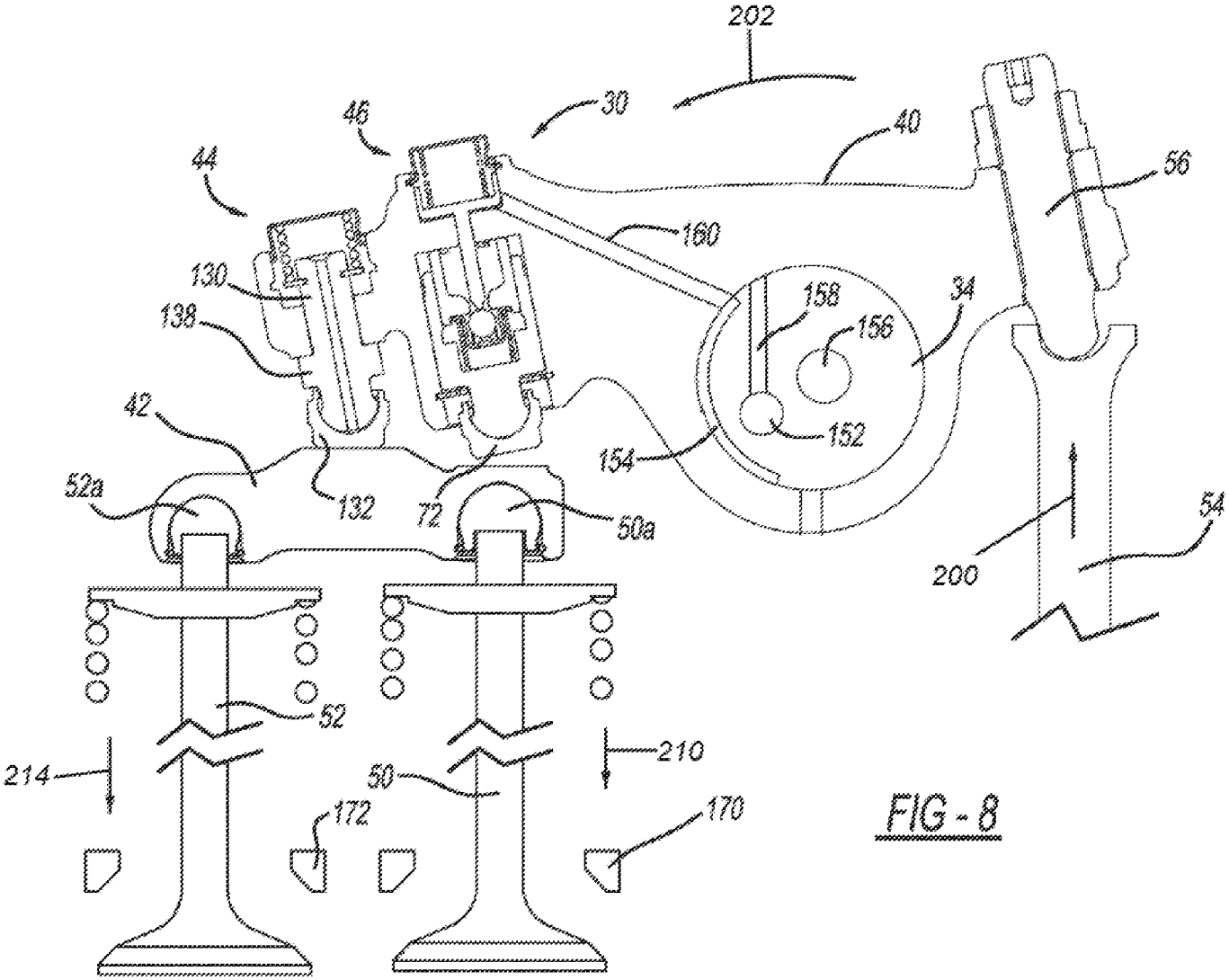
FIG. 8 is a schematic illustration of the exhaust valve rocker arm assembly of FIG. 7 and shown in engine brake mode with further rotation of the rocker arm in the counter-clockwise direction and with both exhaust valves fully opened.
Figure 9:
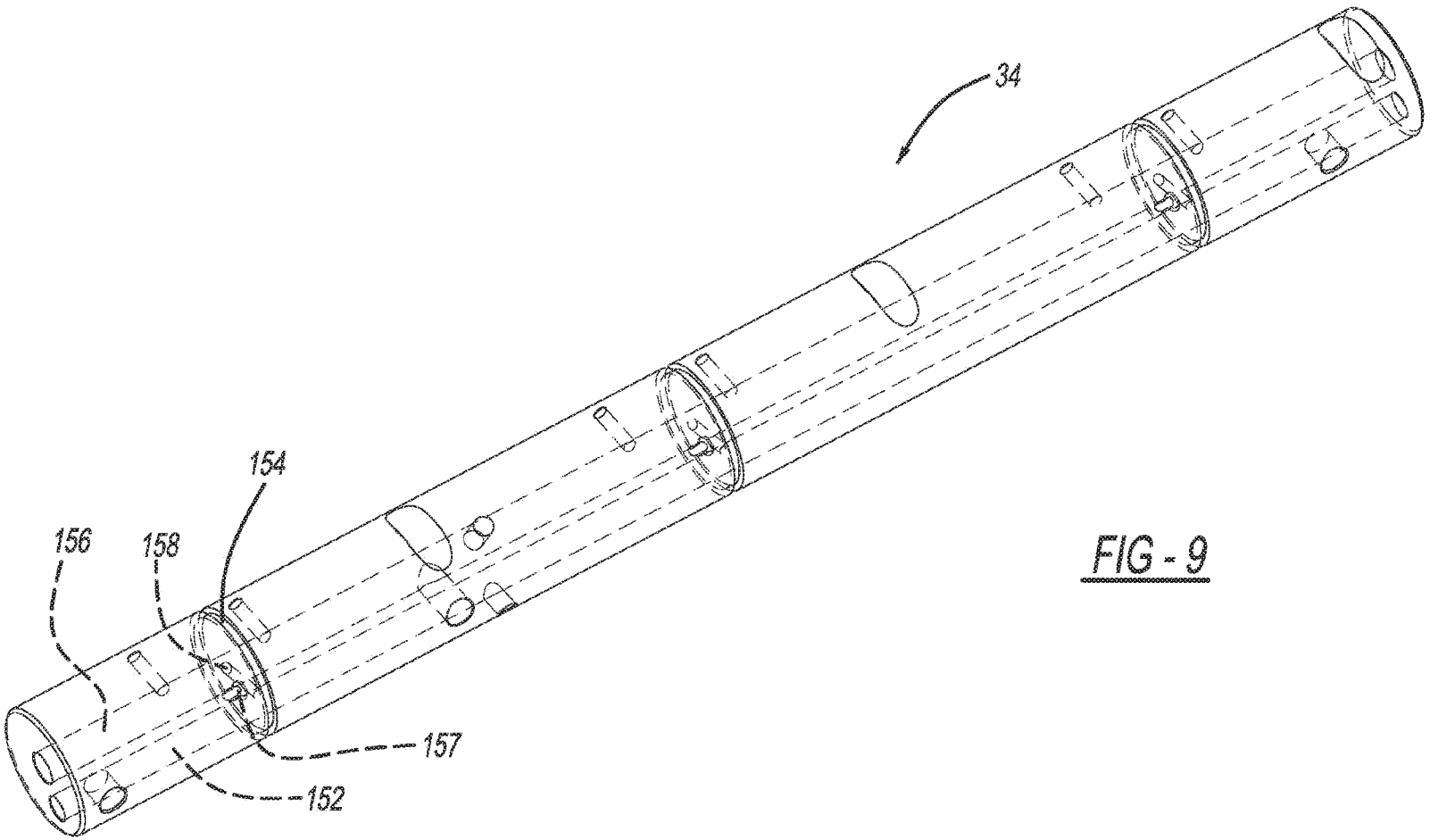
FIG. 9 is a perspective view of a rocker shaft of the rocker arm assembly of FIG. 1.

With reference now to FIG. 8, the rocker arm 40 has rotated further counter-clockwise around the rocker shaft 34. In the example shown, the rocker arm 40 has rotated 12.9 degrees. At this point, the rocker arm 40 has rotated 12.9 degrees and the first and second valves 50 and 52 are at maximum lift off their valve seats 170 and 172. In the example shown the first and second valves 50 and 52 are displaced 15.2 mm off their respective valve seats 170 and 172. As shown, the oil supply passage 160 in the rocker arm 40 is fully disconnected from the connecting passage 158 of the central pressurized oil supply conduit 152 and is now connected to the vent oil conduit 154 by way of the vent lobe 157. In this position, the supply of pressurized oil is interrupted and the oil pressure will drop in the oil supply passage 160. As a result, the biasing member 120 urges the needle 100 downward such that the longitudinal pin portion 110 pushes the check ball 90 off the valve seat 76, opening the HLA assembly 46. Once the check ball 90 is open, the HLA assembly 46 becomes "soft" again and during valve closing will not exercise any force on the first valve 50 that could otherwise prevent its closing. Once the pushrod 54 occupies a position consistent with the base circle on the cam (not shown), the above process will continuously repeat until combustion mode is selected.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

The invention claimed is:

1. An exhaust valve rocker arm assembly operable in a combustion engine mode and an engine braking mode, the exhaust valve rocker arm assembly comprising:

a rocker shaft that defines a pressurized oil supply conduit;

a rocker arm configured to receive the rocker shaft and configured to rotate around the rocker shaft, the rocker arm including a rocker arm oil supply passage defined in the rocker arm;

a valve bridge configured to engage a first exhaust valve and a second exhaust valve;

a hydraulic lash adjuster assembly, disposed on the rocker arm, including a first plunger body movable between a first position and a second position; and a check valve, disposed on the rocker arm, including an actuator configured to selectively release pressure in the hydraulic lash adjuster assembly, wherein the exhaust valve rocker arm assembly is configured such that, in the engine braking mode, by rotation of the rocker arm the pressurized oil supply conduit is brought into fluid communication with the rocker arm oil supply passage so that pressurized oil is communicated through the pressurized oil supply conduit, through the rocker arm oil supply passage and against the actuator such that the first plunger body occupies the first position and acts on the valve bridge during rotation of the rocker arm to a first angle opening the first exhaust valve a predetermined distance while the second exhaust valve remains closed.

2. The assembly of claim 1, wherein the hydraulic lash adjuster assembly is at least partially received by a first bore defined on the rocker arm.

3. The assembly of claim 1, wherein the hydraulic lash adjuster assembly further includes a second plunger body that is at least partially received by the first plunger body, and wherein the second plunger body defines a valve seat.

4. The assembly of claim 3, wherein the check valve is disposed between the first and second plunger bodies, and wherein the check valve further includes a check ball configured to selectively seat against the valve seat on the second plunger body.

5. The assembly of claim 4, wherein the actuator further includes a needle including a longitudinal pin portion and a disk portion, and wherein the exhaust valve rocker arm assembly is configured such that, in the engine braking mode, pressurized oil acts against the disk portion moving the longitudinal pin portion a distance away from the check ball.

6. The assembly of claim 5, wherein the disk portion of the actuator is configured to be received in a second bore defined in the rocker arm, and wherein the first and second bores are collinear.

7. The assembly of claim 1, configured such that rotation of the rocker arm to a second angle disconnects the rocker arm oil supply passage from the pressurized oil supply conduit.

8. The assembly of claim 7, wherein the rocker shaft further defines a vent oil conduit, and wherein the exhaust valve rocker arm assembly is configured such that rotation of the rocker arm to a third angle connects the rocker arm oil supply passage to the vent oil conduit releasing the oil pressure from the actuator.

9. The assembly of claim 1, further comprising: a spigot, disposed on the rocker arm, wherein the exhaust valve rocker arm assembly is configured such that, in the engine braking mode, subsequent to an opening of the first exhaust valve the predetermined distance, further rotation of the rocker arm causes the spigot to move the valve bridge and open the second exhaust valve while further opening the first exhaust valve.

10. The assembly of claim 9, wherein the spigot is configured to slidably translate along a passage defined in the rocker arm prior to moving the valve bridge.

11. An exhaust valve rocker arm assembly operable in a combustion engine mode and an engine braking mode, the exhaust valve rocker arm assembly comprising:

a rocker shaft that defines a pressurized oil supply conduit;

a rocker arm configured to receive the rocker shaft and configured to rotate around the rocker shaft, the rocker arm including a rocker arm oil supply passage defined in the rocker arm;

a valve bridge configured to engage a first exhaust valve and a second exhaust valve;

a hydraulic lash adjuster assembly, disposed on the rocker arm, including a first plunger body movable between a first position and a second position; and a check valve, disposed on the rocker arm, including an actuator configured to selectively release pressure in the hydraulic lash adjuster assembly, wherein the exhaust valve rocker arm assembly is configured such that, in the engine braking mode, pressurized oil is communicated through the pressurized oil supply conduit, through the rocker arm oil supply passage and against the actuator such that the first plunger body occupies the first position and acts on the valve bridge during rotation of the rocker arm to a first angle so as to tilt the valve bridge against an upper end portion of the first exhaust valve to cause the first exhaust valve to open a predetermined distance while the second exhaust valve remains closed.

12. The assembly of claim 11, wherein the hydraulic lash adjuster assembly is at least partially received by a first bore defined on the rocker arm.

13. The assembly of claim 11, wherein the hydraulic lash adjuster assembly further includes a second plunger body that is at least partially received by the first plunger body, and wherein the second plunger body defines a valve seat.

14. The assembly of claim 13, wherein the check valve is disposed between the first and second plunger bodies, and wherein the check valve further includes a check ball configured to selectively seat against the valve seat on the second plunger body.

15. The assembly of claim 14, wherein the actuator further includes a needle including a longitudinal pin portion and a disk portion, and wherein the exhaust valve rocker arm assembly is configured such that, in the engine braking mode, pressurized oil acts against the disk portion moving the longitudinal pin portion a distance away from the check ball.

16. The assembly of claim 15, wherein the disk portion of the actuator is configured to be received in a second bore defined in the rocker arm, and wherein the first and second bores are collinear.

17. The assembly of claim 11, configured such that rotation of the rocker arm to a second angle disconnects the rocker arm oil supply passage from the pressurized oil supply conduit.

18. The assembly of claim 17, wherein the rocker shaft further defines a vent oil conduit, and wherein the exhaust valve rocker arm assembly is configured such that rotation of the rocker arm to a third angle connects the rocker arm oil supply passage to the vent oil conduit releasing the oil pressure from the actuator.

19. The assembly of claim 11, further comprising: a spigot, disposed on the rocker arm, wherein the exhaust valve rocker arm assembly is configured such that, in the engine braking mode, subsequent to an opening of the first exhaust valve the predetermined distance, further rotation of the rocker arm causes the spigot to move the valve bridge and open the second exhaust valve while further opening the first exhaust valve.

20. The assembly of claim 19, wherein the spigot is configured to slidably translate along a passage defined in the rocker arm prior to moving the valve bridge.

* * * * *